US005412813A

United States Patent [19]

Hosley

[11] Patent Number: 5,412,813

[45] Date of Patent: May 9, 1995

[54] SKIER'S DRAG CHUTE

[76] Inventor: Loring F. Hosley, P.O. Box 444, Allenhurst, N.J. 07711

[21] Appl. No.: 149,800

[22] Filed: Nov. 10, 1993

[51] Int. Cl.[6] ..... A41D 3/08

[52] U.S. Cl. ..... 2/69; 2/88; 2/243.1; 280/810

[58] Field of Search ..... 2/69, 88, 89, 243.1; 244/143; 280/810

[56] References Cited

U.S. PATENT DOCUMENTS 2,213,754 9/1940 Thirring ..... 2/88

2,420,344 5/1947 Alexander ..... 2/69

*Primary Examiner*—Clifford D. Crowder

*Assistant Examiner*—Gloria Hale

*Attorney, Agent, or Firm*—John P. Halvonik

[57] ABSTRACT

A skier's drag chute and system for deploying the chute. The apparatus comprises a chute portion that has leg straps in connection with the user's legs and wrist straps for attachment to the user's wrists. A shoulder attachment may be secured around the neck or shoulder of the user in order to secure the top edge of the chute to the user and prevent air from forming under the chute. The chute portion has curvilinear edges along the top and bottom edges of the chute. The chute remains in resting position on the back of the skier until the skier decides on slowing down. The skier extends his arms allowing the chute to deploy and thus slow the speed of the skier.

4 Claims, 1 Drawing Sheet

SKIER'S DRAG CHUTE

FIELD OF INVENTION

BACKGROUND OF THE INVENTION

The invention relates to devices that provide resistance to air and, in particular, to a chute that is connected to a skier as he descends down a hill. The chute is not deployed so long as the skier keeps his arms inward toward his body. In order to deploy the chute, the skier stands erect and extends his arms outward causing the initial passage of air to deploy the chute into the fully open position. In the fully open position, the skier rides on a "cushion" of air which slows his momentum considerably.

DESCRIPTION OF THE PRIOR ART

While there are human garments that are designed for providing resistance to the wind, e.g.: U.S. Pat. No. 4,220,299 there are no chutes in the prior art that are specially designed to be deployed by the skier from his position on the skis, viz.: a crouching position.

SUMMARY OF THE INVENTION

The invention is a ski chute system for deploying a drag chute from the body of a skier as he/she is moving down a hill in order to readily slow the skier. The chute portion of the system is secured to the wrists, legs, and shoulders of the user so that it may be maintained near the back of a skier in his tuck position until he deploys the chute. The chute is deployed by the skier extending his arms. The chute itself is attached to the arms of the skier by wrist attachments and to the legs via leg straps. An additional breakaway strap may be attached around the shoulders of the skier. Additional tie on straps may be used around the neck and the waist of the skier in order to help hold the chute in the non-deployed mode of operation. The chute has upper and lower edges of arcuate shape in order to prevent the wind from catching the chute before deployment It is an object of the invention to provide a skier's drag chute that allows one to slow down and to use with the edges of the skies while stopping or turning.

Another objective is to provide a skier's drag chute that allows one to enjoy riding a cushion of air while on skis. Such a ride is enjoyable and may be likened to either an elevator coming to a stop or changing directions on a roller coaster ride.

Another objective is to provide a reliable and readily deployable system for deploying a chute from the body of a skier in order to slow him down.

Yet another objective is to provide a system for a skier, thus allowing him to quickly regain speed control in order to prevent accidents caused by high speeds which may result in falls and/or collisions.

Other objectives of the invention will become apparent to those skilled in the art once the invention has been shown and described.

DESCRIPTION OF THE PREFERRED EMBODIMENT

Figure 1:
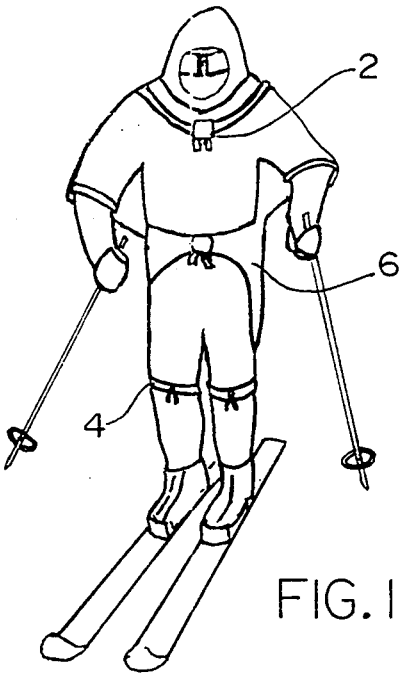
FIG. 1 Chute in use non-deployed.
Figure 3:
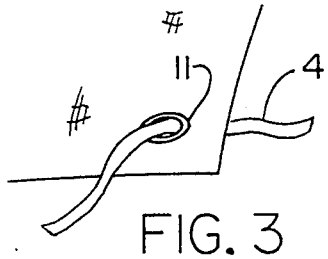
FIG. 3 Detail of leg straps.
Figure 4:
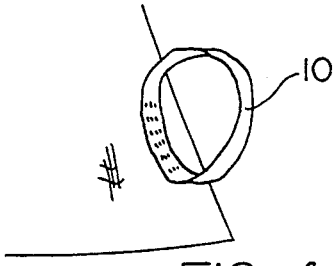
FIG. 4 Detail of wrist straps.
Figure 5:
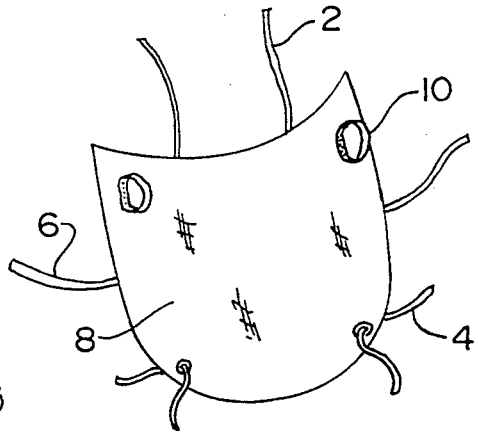
FIG. 5 Plan view of chute.

The chute portion 8 of the system should be of generally square or rectangular construction and may be of any flexible fabric suitable for supplying resistance to the wind. Preferred fabrics would be for example: nylon, polyester, cotton, etc. The top edge 9 of the chute should be of arcuate construction, i.e. this edge is curved inward toward the center of the chute. The use of a curved edge is to eliminate the possibility that currents of air may catch the undeployed chute and open it prematurely while serving to aerodynamically increase the air drag in the deployed position.

A pair of leg attachment lines 4 are connected to the bottom edges of the chute member. Each of the lines has two ends which may be tied or otherwise attached to one of the user's legs prior to use. The lines may be secured to the chute by creating an eyelet 11 in each of the two bottom corners of the chute. Each eyelet may be reinforced with a metal grommet. Rope or straps or similar means may be strung through each eyelet to function as the leg attachment lines. Alternately, such leg straps may be sewn into the fabric that makes up the chute. Each leg attachment strap is then joined around the legs of the user.

At each of the two corners of the upper edge of the chute portion is a wrist attachment means 10. It is preferred that the wrist attachment means be an elastic strap directly connected to one of the upper corners of the chute. In this type strap, the skier would simply slide his wrists into the straps in order to secure the chute to his wrists. In the alternative, hook and loop fabric material (VELCRO) may also be used to join a pair of straps around the wrist. These straps would not have to be of elastic construction. It is believed that the wrist attachment means is preferable to a means that would attach to the hand, thus keeping the hands free for holding skis etc.

The top edge of the chute may have a strap 2 or other means for joining about the neck or shoulder for two reasons. The first is to prevent premature air penetration in the chute's closed mode, see FIG. 1. The top edge of the chute is held tightly against the skier's back and/or neck. The other is to secure heavier fabric materials about the shoulder area. One preferred method is to extend straps from the back of the chute up and around the neck in the manner of a scarf. The ends may be tied to one another around the neck or may use safety releases that rely on hook and loop material portions (VELCRO).

This neck attachment should prevent air from getting up under the chute from the top edge, i.e. the neck attachment will keep the upper edge of the chute flush against the upper back and/or neck of the skier during the non-deployed mode. Such a consideration may be important to prevent premature deployment of the chute. This upper strap may also be constructed to breakaway from the skier for safety reasons.

An optional belt attachment 6 may also be connected near the middle of the side edges of the chute. The belt may simply be two fabric portions that may be tied or otherwise joined to one another around the waist of the user. Keeping the chute close to the user's body helps prevent air from getting up under the chute prematurely. If the belt is used, it should be undone when the chute is deployed.

Preferred length of the upper pair of wrist attachment straps would be about 4–8" and the preferred length of the leg attachment means would be about 12", i.e. the string or cord length would be about 12".

The chute may also have a series of pleats that run from the corners of the chute toward the center of the chute. The pleats are folds in the material that encourage the chute to remain folded on the back when in use.

To use the chute, the skier's arms and legs are attached to the chute by connecting the wrist and leg attachment means to the limbs. The optional shoulder, neck and waist attaching means may also be conected. The chute rests somewhat against the top of the skier's back and also hangs down from him or her. The arms should be in the tuck position, see FIG. 1. This ensures that the chute will not deploy prematurely-the purpose of course is to allow the skier to activate the chute upon opening his arms.

As the skier moves down the slope, there is likely to come a time when the skier needs to slow down. Oftentimes the skier may reach the bottom of the slope and there will be no place to go. However, there are times when the skier will need to slow down to avoid an accident such as an oncoming tree or another skier, etc. Here the ski chute may find an important use in that it enables the skier to slow down in a hurry. By extending his arms the skier can activate the chute nearly immediately upon sensing danger and the need for stopping quickly. The use of a deployable chute enables one to quickly reduce one's speed on skis without having to use ski poles or to turn and use the edges of the skis.

When in normal use the chute will be used deliberately by the skier. The chute will be used by the skier in normal ski operation. A typical scenario would be as follows: The skier puts the chute in a non-deployable or closed mode while waiting in the lift line. It remains closed until the skier dismounts off the chair lift. Thus, the chute is secured while on the lift. In addition, it has kept him warm from the seat and the cold brisk air. Next, typically the skier walks a short ways until he comes upon his selected trail. Assuming, this to be an intermediate run which has an average amount of speed. The skier begins his trip down in the closed mode. He makes some normal turns without using the chute simply because he wants to.

Figure 2:
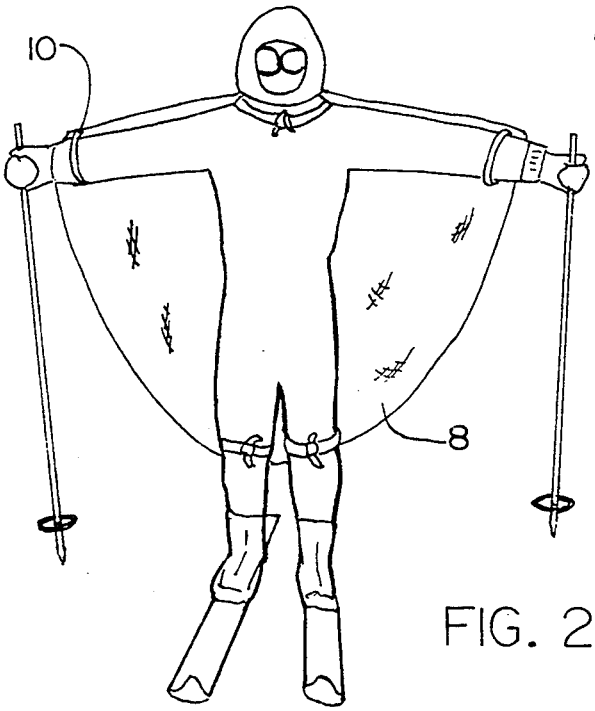
FIG. 2 Deployed chute.

Now, he decides he wants to go faster and use the chute while skiing. He begins to pick up speed at a rapid pace while descending straight down. At some point, he anticipates his desire to rapidly slow for a gentle turn. He deploys the chute which slows him down and give him a feeling of deacceleration while controlling his speed into the turn, see FIG. 2. Now that he has turned he decides to pick his speed up so he brings his arms in, thus shutting down the resistance and once again allowing him to increase speed to his desired level.

He continues thusly, when suddenly he realizes there is a merging trail coming up on his left. Suddenly realizing he is entering the unfamiliar merge, he decides to again deploy the chute by opening his arms and thus enters the merging skier's trail at a safe and reduced speed. Once he has found a lane or opening he can again increase speed (close chute) and continue down the mountain. He can play with his speed by racing it up, then dragging it down. He can "float" into turns and lift some weight off his boots.

I claim:

1. A deployable chute apparatus for use on skiers, said apparatus comprising: a chute of flexible material and having top and bottom edges, two side edges, two upper corners and two lower corners, said top edge of curved construction so as to form a concavely curved edge running between said two upper corners, a wrist attachment means attached to each said upper corners of said chute, leg attachment means in connection with said chute near said lower corners of said chute, a belt having two portions, each attached to said chute near one of said side edges of said chute.

2. The apparatus of claim 1 wherein said wrist attachment means comprises a loop made of elastic material connected to about near one of said upper corners of said chute for securing around the wrist of the skier.

3. The apparatus of claim 2 wherein each leg attachment means comprises a strap in connection with said chute at about near one of said lower corners of said chute so that said straps may be secured about the legs of said user.

4. The apparatus of claim 3 having a shoulder attachment means in connection with said chute and near said top edge of said chute, said shoulder attachment means having two scarf portions for securing around the neck of the user in order to support said top edge of said chute upon said user.

* * * * *